US005441253A

United States Patent [19]

Takemoto et al.

[11] Patent Number: 5,441,253

[45] Date of Patent: Aug. 15, 1995

[54] PAPER SHEET CONVEYING APPARATUS

[75] Inventors: Takatoshi Takemoto; Kazunari Kawashima, both of Tokyo; Hideyuki Kadomatsu, Odawara; Moriyuki Aoyama, Okazaki; Takaharu Nakamura, Toyohashi, all of Japan

[73] Assignee: Kabushiki Kaisha Ace Denken, Tokyo, Japan

[21] Appl. No.: 167,947

[22] PCT Filed: Jun. 26, 1991

[86] PCT No.: PCT/JP91/00862

§ 371 Date: Dec. 20, 1993

§ 102(e) Date: Dec. 20, 1993

[87] PCT Pub. No.: WO93/00283

PCT Pub. Date: Jan. 7, 1993

[51] Int. Cl.[6] ..... B65H 3/04

[52] U.S. Cl. ..... 271/34; 271/122; 271/125; 271/273

[58] Field of Search ..... 271/122, 124, 125, 34, 271/35, 273

[56] References Cited

U.S. PATENT DOCUMENTS

| | | | |
|---|---|---|---|
| 3,108,801 | 10/1963 | Van Dalen | 271/34 |
| 3,272,500 | 9/1966 | Van Dalen et al. | 271/34 |
| 4,416,449 | 11/1983 | McInerny | 271/124 |
| 4,526,358 | 7/1985 | Ura et al. | 271/34 |

FOREIGN PATENT DOCUMENTS

| | | | |
|---|---|---|---|
| 3902681 | 8/1989 | Germany | 271/125 |
| 59-4547 | 1/1984 | Japan . | |
| 60-133844 | 9/1985 | Japan . | |
| 63-252868 | 10/1988 | Japan . | |
| 63-252869 | 10/1988 | Japan . | |
| 1-275339 | 11/1989 | Japan . | |
| 2-305736 | 12/1990 | Japan . | |
| 3-8639 | 1/1991 | Japan . | |
| 3-192053 | 8/1991 | Japan . | |

*Primary Examiner*—H. Grant Skaggs

*Attorney, Agent, or Firm*—Lowe, Price, LeBlanc & Becker

[57] ABSTRACT

A paper sheet conveying apparatus, a paper sheet separator comprising a conveyer belt (24) movable in a paper sheet delivering direction at all times, a drive roller (42) rotating in one direction, and a separator roller (41) disposed between the drive roller (42) and the conveyer belt (24) so as to come into engagement with either one of the drive roller (42) or the conveyer belt (24) exclusively while maintaining a predetermined gap from the other so that a paper sheet on the conveyer belt (24) is moved back toward the upstream side when the separator roller (41) comes into engagement with the drive roller (42). The drive roller (42) is supported by a pivotable support arm (44) operatively connected for adjusting the predetermined gap.

8 Claims, 4 Drawing Sheets

PAPER SHEET CONVEYING APPARATUS

FIELD OF TECHNOLOGY

This invention relates to a paper sheet conveying apparatus for conveying inserted paper sheets one by one after separating them from one another.

BACKGROUND TECHNOLOGY

A paper sheet conveying apparatus is currently known which is equipped with a separating means including a conveyer belt, a drive roller rotating in one direction at all times, and two separator roller disposed between the drive roller and the conveyer belt so as to come into engagement with one of the drive roller and the conveyer belt exclusively with a predetermined gap from the other. However, this conventional apparatus was not equipped with any means for easily setting the predetermined gap externally. Further, as shown in FIGS. 3 and 5, the two separator rollers include a pair of rollers 2, 3 individually rotatably mounted on a common axis 1 in association with a pair of laterally spaced conveyer belts A, B, and the rollers 2, 3 have not only their inner sides 2*b*, 3*b* but also their outer sides 2*a*, 3*a* engageable with the drive roller 4.

The predetermined gap is generally very small and is usually defined to be larger than the thickness of a single paper sheet and smaller than the total thickness of two paper sheets. In the absence of any means for externally adjusting such a very small gap, the separating ability would be reduced so that when an accident, such as double-sheet conveying, occurs, an adequate action cannot be achieved quickly.

Given that the two separator rollers 2, 3 are rotatable independently from one another and that the outer contact wheels 2*a*, 3*a* engageable with the drive roller 4 are added to convey the entire width of a paper sheet, if a paper sheet M with a folded corner e as shown in FIG. 4 is inserted, one separator roller 2 will come into contact with the drive roller 4 to rotate so as to push the paper sheet back to the upstream side U as shown in FIG. 5 while the other separator roller 3 will not come into contact with the drive roller 4 so it will continue rotating so as to move the paper sheet toward the downstream side D. This causes the paper sheet M to skew and, if the worst happens, to become jammed.

DISCLOSURE OF THE INVENTION

With the foregoing problems of the conventional art in mind, it is an object of this invention to provide a paper sheet conveying apparatus in which a predetermined gap between a conveyer belt and a separator roller and between the latter and a drive roller can be adjusted and which does not cause skew or jamming.

According to an aspect of this invention, the above object can be accomplished by a paper sheet conveying apparatus equipped with paper sheet separating means including a conveyer belt movable in a paper sheet delivering direction, a drive rollers rotating in one direction at all times, and two separator rollers disposed between the drive roller and the conveyer belt so as to come into contact with one of the drive roller and the conveyer belt exclusively with a predetermined gap from the other so that a paper sheet on the conveyer belt is moved back toward the upstream side when the separator roller comes into contact with the drive roller, wherein the drive roller is supported by a pivotable support arm operatively connected with setting means for setting the predetermined gap.

The setting means may be, for example, a setting cam plate engaging the support arm for pivotally moving the support arm. This setting cam plate may have a series of markings for reading the value of the setting.

The conveyer belt may be a double structure including a pair of parallel spaced conveyer belts, and the separator roller may be a double structure including a pair of axially spaced separator rollers in association with the pair of parallel spaced conveyer belts. The pair of axially spaced separator rollers may have on their confronting inner sides a pair of contact wheels for contacting the drive roller.

Paper sheets inserted into the apparatus are conveyed to the downstream side by the conveyer belt. If the paper sheets are inserted one by one between the separator roller and the conveyer belt, the separator roller will be moved only by a distance corresponding to the thickness of a single paper sheet, i.e. within a predetermined gap, so that the separator roller will not come into contact with the drive roller, and so continue to convey the paper sheet toward the downstream side.

If two or more paper sheets are inserted under the separator roller, the separator roller will be pushed up by these paper sheets to close the predetermined gap with the drive roller so that these two rollers comes into contact with one another. Upon receipt of the driving force of the drive roller, the separator roller will rotate reversely to push back one paper sheet, which is in contact with the separator roller, to the upstream side. Meanwhile the other paper sheet on the conveyer belt side will be conveyed to the downstream side by the conveyer belt. Thus these two paper sheets will be separated from each other and will be conveyed one by one.

When the separating ability is found to have been lowered, the user may rotatably move the support arm, which is pivotally mounted on the drive roller, by the setting means such as a setting cam plate to adjust the predetermined gap. At that time, with the series of markings for reading the value of the setting, it is possible to easily perform a fine and delicate adjustment.

Partly since the two separate rollers in association with the plurality of conveyer belts are integral with one another and partly since the contact wheels for contacting the drive roller are located only at the inner sides of the separator rollers, even if a paper sheet with a folded corner is inserted, the two separator rollers are rotated in the same direction, thus preventing the paper sheet from becoming skewed.

In the paper sheet conveying apparatus in which the separator roller is disposed between the driver roller and the conveyer belt so as to come into contact with only one of either the drive roller or the conveyer belt while maintaining a predetermined gap from the other, partly since the drive roller is supported by a pivotable support arm and partly since the setting means for setting the predetermined gap, for example, a setting cam plate engaging the support arm for pivotally moving the support arm, is mounted on the support arm, it is possible to adjustably set the predetermined gap. In particular with the setting cam plate having a series of markings for reading the value of the setting, even a delicate adjustment can be performed much more easily and accurately.

Further, partly since the symmetrical rollers of the separator rollers corresponding to the plurality of conveyer belts are integral with one another and partly since the contact wheels for contacting the drive roller are located only at the inner sides of each roller, even if a paper sheet with a folded corner is inserted, the two separator rollers are rotated in the same direction, thus preventing the paper sheet from skewing.

BRIEF DESCRIPTION OF THE DRAWINGS

FIG. 1 and FIG. 2 show one embodiment of this invention;

FIG. 2 shows the paper sheet separating operation;

FIG. 3 is a front view of a conventional separator roller;

FIG. 4 shows a paper sheet with a folded corner; and

FIG. 5 shows the operation of the conventional separator roller upon receipt of the paper sheet with a folded corner.

PREFERRED EMBODIMENT OF THE INVENTION

One embodiment of this invention will now be described with reference to the accompanying drawings.

Figure 1:
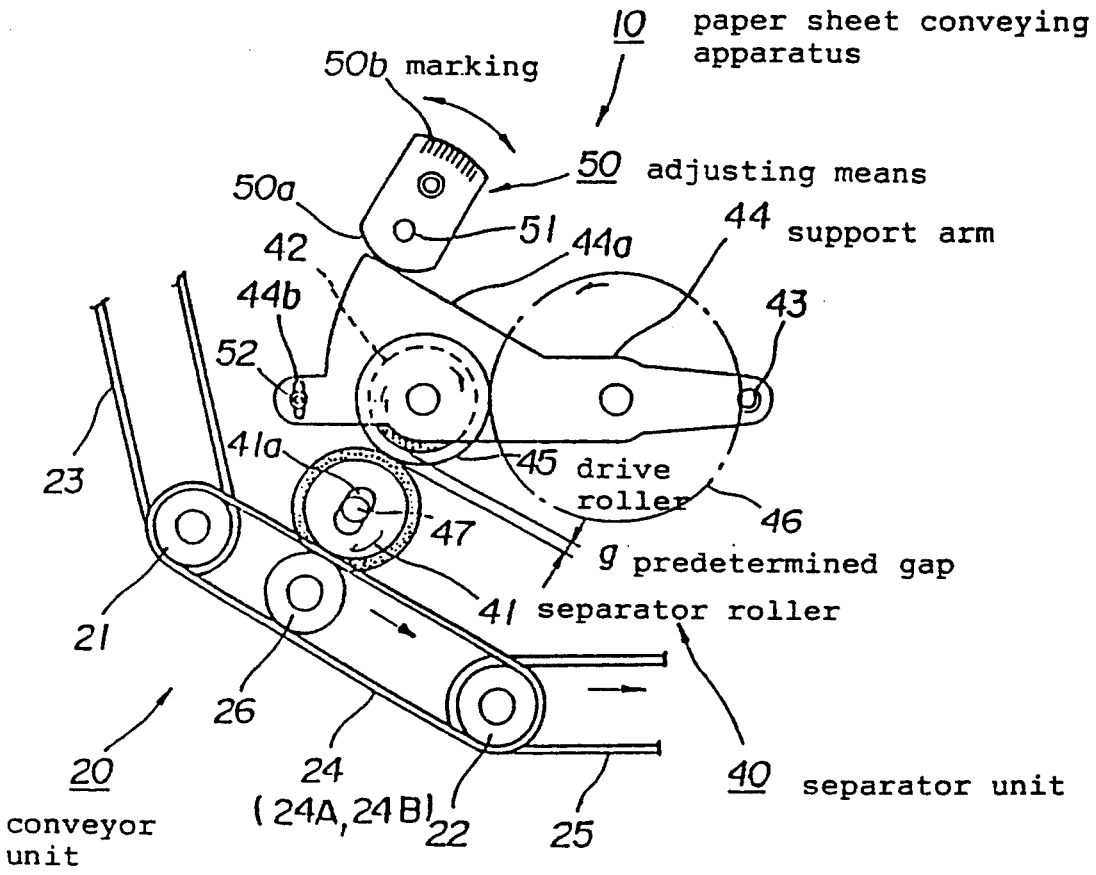
FIG. 1 shows the structure of a paper sheet conveying apparatus.

As shown in FIG. 1, a paper sheet conveying apparatus 10 comprises a conveyer unit 20, which includes a plurality of conveyer belts 23, 24, 25 wound on a plurality of pulleys 21, 22, a separator roller 41 disengageably engaging the conveyer belt 24 of the conveyer unit 20, and a separator unit 40, in which a drive roller 42 disengageably engaging the separate roller 41 of the conveyer unit 20 is pivotally supported by a support arm 44 pivoted by a pivot 43. The conveyer unit 20 is driven, upon receipt of the driving force from a non-illustrated drive means, to convey a paper sheet to the right side in FIG. 1.

Figure 2:
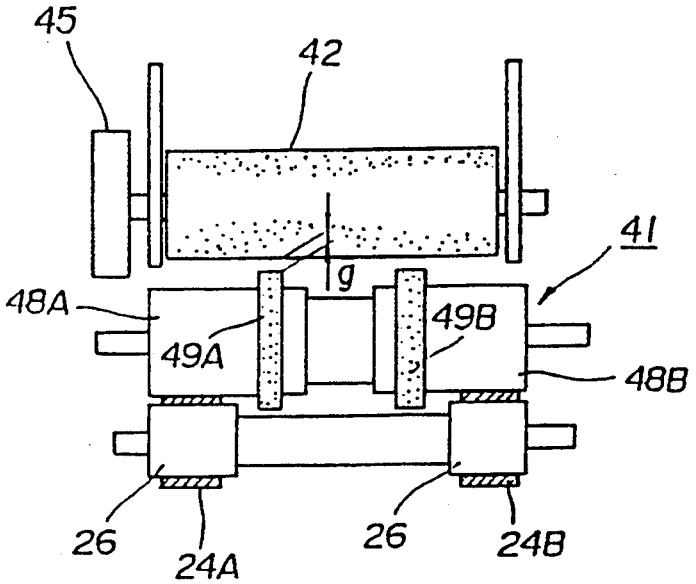
Figure 3:
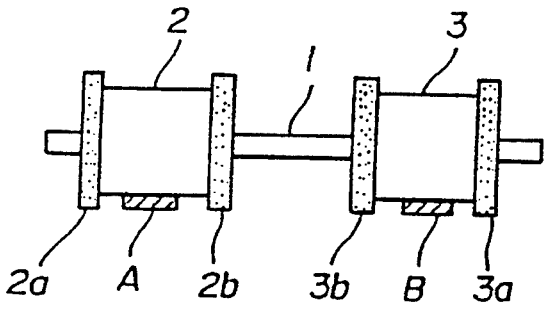
FIG. 3 (PRIOR ART)
FIG. 3 to FIG. 5 shows the prior example.

The conveyer belt 24 is a double structure which includes, as shown in FIG. 2, a pair of laterally spaced conveyer belts 24A, 24B disengageably engaging the separator roller 41 and a pair of support rollers 26, 26 confronting the separator roller 41.

In the separator unit 40, the separator roller 41 is comprised of, as shown in FIG. 2, a pair of separator rollers 48A, 48B, one or either side, in association with the conveyer belts 24A, 24B and a pair of contact wheels 49A, 49B mounted on respective confronting inner sides of the separator rollers 48A, 48B for contacting with the drive roller 42.

Coaxially connected with the drive roller 42 is a gear 45 meshing with a gear 46 (shown in FIG. 1), through which a one-way rotating force is to be transmitted to the drive roller 42 by non-illustrated drive means.

Normally there is defined a very small predetermined gap g between the separator roller 41 and the drive roller 42. The predetermined gap g is set to a value larger than the thickness of a single paper sheet and smaller than the total thickness of two paper sheets.

As shown in FIG. 1, the separator roller 41 has an elongated axial hole 41*a* which moves within the predetermined gap g about a shaft 47 so as to come into contact with either the conveyer belt 24 or the drive roller 42, but only one at a time.

As a setting means for setting the predetermined gap g, there is provided a setting cam plate 50.

The setting cam plate 50 moves about a cam shaft 51 and has a cam surface 50*a* pressing against a contact surface 44*a* of the support arm 44. The support arm 44 is normally energized upwardly in FIG. 1 by a non-illustrated energizing means. The support arm 44 is pivotally movable about a pivot 43 and has, at the opposite end of the pivot 43, a slot 44*b* in which a small screw 52 is inserted for fastening.

The setting cam 50 has a series of markings 50*b* for reading the value of setting as shown in FIG. 1.

The operation of the apparatus will now be described.

In the separator unit 40, the drive roller 42 is coaxial with the gear 45 meshing with the gear 46, which is operatively connected to non-illustrated drive means for rotation in one direction, and is at all times rotating counterclockwise in FIG. 1.

When a paper sheet is inserted under the separator roller 41, the separator roller 41 will be raised by a distance corresponding to the thickness of a single paper sheet. At that time, since the predetermined gap g between the separator roller 41 and the drive roller 42 is larger than the thickness of a single paper sheet, these two rollers 41, 42 will not come into contact with one another so that the paper sheet will be conveyed to the downstream side by the conveyer belt 24.

If two or more paper sheets are inserted, the separator roller 41 will come into contact with the drive roller 42 to rotate clockwise since the predetermined gap g is smaller than the total thickness of two paper sheets. The separator roller 41 will thereby push back the upper paper sheet, which is in contact with the separator roller 41, to the upstream side and will convey only the first paper sheet, which is in contact with the conveyer belt 24, to the downstream side.

Figure 4:
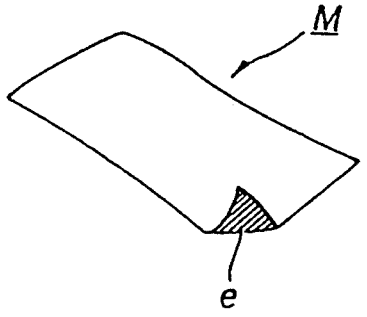
Figure 5:
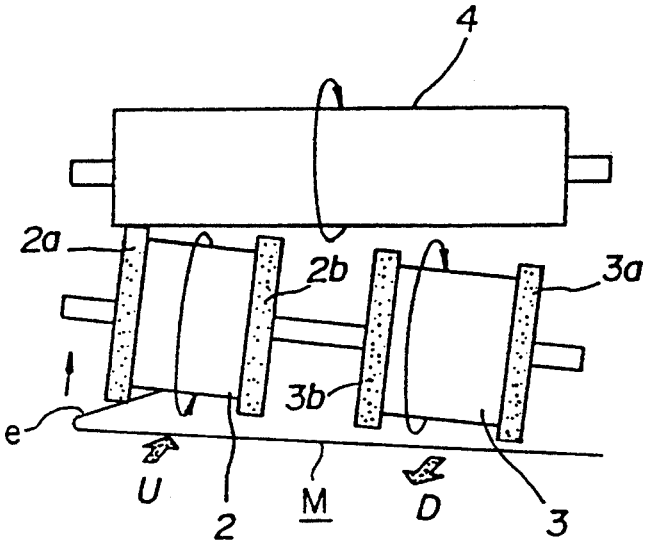
FIG. 5 (PRIOR ART)

Because the separator rollers 48A, 48B are integral with one another as shown in FIG. 2, even if one of the separator rollers, e.g. 48A, is raised by a paper sheet M with a folded corner of FIG. 4 to come into contact with the drive roller 42, both the separator rollers 48A, 48B will be rotated in the same direction so that the paper sheet will be prevented from becoming skewed, which would have happened if it had received rotating forces of different directions.

We claim:

1. A paper sheet conveying apparatus equipped with paper sheet separating means including a conveyer belt movable in a paper sheet delivering direction, a drive roller normally rotating in one direction at all times, and a separator roller disposed between said drive roller and said conveyer belt so as to come into contact with one of said drive roller and said conveyer belt exclusively with a predetermined gap from the other so that a paper sheet on said conveyer belt is moved back toward the upstream side when said separator roller comes into contact with said drive roller, wherein said drive roller is supported by a pivotable support arm operatively connected with adjusting means for adjusting said predetermined gap, and wherein said conveyer belt is a double structure including a pair of parallel spaced conveyer belts, and said separator roller is a double structure including a pair of axially spaced separator rollers in association with said pair of parallel spaced conveyer belts, said pair of axially spaced separator rollers having on their confronting inner sides of a pair of contact wheels for contacting said drive roller.

2. A paper sheet conveying apparatus according to claim 1, wherein said adjusting means is an adjusting cam plate engaging said support arm for pivotally moving said support arm.

3. A paper sheet conveying apparatus according to claim 2, wherein said adjusting cam plate has a series of markings for reading the value of the adjusting.

4. A paper sheet conveying apparatus comprising:

a conveyer belt for conveying paper sheets, a drive roller normally rotating in one direction, a separator roller movably disposed between said drive roller and said conveyer belt so as to come into contact exclusively with one of said drive roller and said conveyer belt according to the movement of said separator roller itself, said conveyer belt comprising:

a pair of parallel spaced belts, said separator roller comprising:

a pair of rollers which correspond to said pair of belts respectively, a pair of contact wheels located between said pair of belts and also located at a position so as to form a predetermined gap from said drive roller when said pair of rollers are in contact with said conveyer belt.

5. A paper sheet conveying apparatus according to claim 4, wherein said gap is defined to be larger than the thickness of a single paper sheet to be conveyed and smaller than the total thickness of two of said paper sheets.

6. A paper sheet conveying apparatus according to claim 4, wherein said gap is defined in such a distance that said pair of contact wheels may not come into contact with said drive roller when only one paper sheet are conveyed between said pair of rollers and said conveyer belt, while said pair of contact wheels may come to contact with said drive roller when more than one paper sheets are conveyed in an overlapped state.

7. A paper sheet conveying apparatus according to claim 4, wherein said pair of contact wheels have a larger outer diameter than said pair of rollers.

8. A paper sheet conveying apparatus according to claim 7, wherein said pair of rollers are integrated.

* * * * *